US012807444B2

(12) United States Patent
Möhringer et al.

(10) Patent No.: US 12,807,444 B2
(45) Date of Patent: Nov. 24, 2026

(54) FOLDING MACHINE, STITCHING OR BINDING MACHINE, SYSTEM FOR OPERATING A FOLDING AND STITCHING OR BINDING MACHINE, LIFTING MODULE FOR FOLDED SHEETS, MOBILE STORAGE MODULE FOR FOLDED SHEETS, AND PRODUCTION METHOD

(71) Applicant: Heidelberger Druckmaschinen AG, Heidelberg (DE)

(72) Inventors: Markus Möhringer, Weinheim (DE); Harald Wörner, Wiesloch (DE); Axel Diehl, Wiesbaden (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 210 days.

(21) Appl. No.: 18/760,466

(22) Filed: Jul. 1, 2024

(65) Prior Publication Data

US 2025/0011117 A1 Jan. 9, 2025

(30) Foreign Application Priority Data

Jul. 5, 2023 (DE) ..... 10 2023 117 693.5

(51) Int. Cl.
*B65H 1/28* (2006.01)
*B65H 13/00* (2006.01)
*B65H 45/30* (2006.01)

(52) U.S. Cl.
CPC ..... *B65H 13/00* (2013.01); *B65H 45/30* (2013.01)

(58) Field of Classification Search
CPC ..... B65H 1/28; B65H 5/006; B65H 13/00; B65H 31/3054; B65H 31/3072;
(Continued)

(56) References Cited

U.S. PATENT DOCUMENTS 5,129,781 A 7/1992 Petersen
9,085,435 B2 7/2015 Jiwan et al.
(Continued)

FOREIGN PATENT DOCUMENTS

CN 205045337 U 2/2016
CN 113525483 A 10/2021
(Continued)

OTHER PUBLICATIONS

Espacenet machine translation of WO2023011899A2; https://translationportal.epo.org/emtp/translate/?ACTION=description-retrieval&COUNTRY=WO&ENGINE=google&FORMAT=docdb&KIND=A2&LOCALE=en_EP&NUMBER=2023011899&OPS=ops.epo.org/3.2&SRCLANG=de&TRGLANG=en (Year: 2023).*

*Primary Examiner* — Leslie A Nicholson, III
(74) *Attorney, Agent, or Firm* — Laurence A. Greenberg; Werner H. Stemer; Ralph E. Locher

(57) ABSTRACT

A folding machine includes a delivery arm, a lifting module and a mobile storage module movable horizontally relative to the lifting module. The lifting module is downstream of the delivery arm and includes a vertically positionable lifting level for folded sheets. During the delivery, the storage module is downstream of the lifting module and includes at least two vertically disposed storage levels drivable separately for putting a plurality of folded sheets into storage. A mobile storage module of a machine for folded sheets includes vertically disposed storage levels being driven separately for the storage of folded sheets. The storage levels include a driven second coupling element of a coupling device. A first coupling element of the coupling device is part of a lifting module. The machine improves workflow for post press processing. A production system for the graphic design industry in the post-production of printed products is also provided.

1 Claim, 5 Drawing Sheets

(58) Field of Classification Search
CPC ..... B65H 45/30; B65H 2301/42264; B65H 2301/42265; B65H 2405/332; B65H 2801/48
USPC ..... 270/32
See application file for complete search history.

(56) References Cited

U.S. PATENT DOCUMENTS

| | | | | |
|---|---|---|---|---|
| 9,701,105 | B2 * | 7/2017 | Schäfer | B41F 27/06 |
| 10,377,602 | B2 * | 8/2019 | Adami | B65H 29/50 |
| 12,534,258 | B2 * | 1/2026 | Peutl | B65B 43/126 |
| 2004/0222584 | A1 | 11/2004 | Krieger et al. | |
| 2024/0270430 | A1 | 8/2024 | Peutl et al. | |

FOREIGN PATENT DOCUMENTS

| | | | |
|---|---|---|---|
| DE | 2063282 | A1 | 7/1972 |
| DE | 3811290 | C1 | 11/1989 |
| DE | 10344026 | A1 | 12/2004 |
| DE | 102009039050 | A1 | 3/2011 |
| DE | 102014114952 | A1 | 4/2016 |
| DE | 102022118506 | A1 | 5/2023 |
| WO | 2023011899 | A2 | 2/2023 |

* cited by examiner

FOLDING MACHINE, STITCHING OR BINDING MACHINE, SYSTEM FOR OPERATING A FOLDING AND STITCHING OR BINDING MACHINE, LIFTING MODULE FOR FOLDED SHEETS, MOBILE STORAGE MODULE FOR FOLDED SHEETS, AND PRODUCTION METHOD

CROSS-REFERENCE TO RELATED APPLICATION

This application claims the priority, under 35 U.S.C. § 119, of German Patent Application DE 10 2023 117 693.5, filed Jul. 5, 2023; the prior application is herewith incorporated by reference in its entirety.

BACKGROUND OF THE INVENTION

The invention relates to a machine for folding, a machine for stitching or a machine for binding, provision and operation of a system formed of at least one machine for folding and at least one machine for stitching or a machine for binding, a lifting module, a mobile storage module and a production method, according to the invention.

FIELD OF THE INVENTION

The invention is based on the technical field of the graphic design industry and, in particular, in the field of stitching or binding collated folded sheets or the industrial, i.e. high-quality and highly productive, manufacture (folding and subsequent stitching or binding) of products, such as for example brochures, preferably formed of printed paper.

Folding machines and saddle stitchers, adhesive binders and thread binders are known from the field of post press processing. It is already known to stack folded products in the folding machine on pallets and to transport the folded products on the pallet to a different post processing machine (saddle stitcher, adhesive binder, thread binder) and to process the folded products further therein.

German Patent Application DE 103 44 026 A1, corresponding to U.S. Patent Application No. 2004/0222584 A1, as well as German Patent Application DE 10 2014 114 952 A1, disclose in each case the post processing of printed products in a folding machine and directly downstream thereof in a saddle stitcher. The transport of the products from the folding machine to the saddle stitcher takes place in each case via a transport device which is disposed in a stationary manner between the machines, for example via an oblique roller table.

Many different types of devices for warehousing or storing objects are known from the field of warehouse technology.

Chinese Utility Model CN 205045337 U discloses a stationary warehouse rack with at least two warehousing levels disposed one on top of the other for warehousing pallets. Each level includes driven rollers for the horizontal movement of the pallets when putting the pallets into storage or taking them out of storage. The rack has laterally adjacent to the levels an associated and stationary lifting device which moves the pallets vertically, when putting them into storage, to the height of the respective levels (and vice versa when taking the pallets out of storage), to which end the lifting device includes a drive. The lifting device also includes driven rollers for horizontally moving the pallets when putting them into storage or taking them out of storage. It remains unclear how the respective rollers are driven. A mobility of the rack as a whole is not discussed. A coupling or uncoupling of the rack from the lifting device is also not addressed.

Chinese Patent Application CN 113525483A discloses a movable carriage with a centrally disposed warehousing unit and with a loading unit which can be moved therewith and an unloading unit which can be moved therewith. The warehousing unit includes a plurality of warehouse levels disposed one on top of the other. Those warehouse levels are configured in each case as conveyor belts with containers fastened thereto. The containers can be loaded and unloaded with goods, to which end they are conveyed horizontally to the respective loading unit or unloading unit. Both the loading unit and the unloading unit are configured as lifting devices. It remains unclear how the respective conveyor belts are driven. A coupling and uncoupling of the warehousing unit to and from the lifting devices is not discussed. As a result of the two lifting devices, the carriage is of complex construction and its manufacture is therefore presumed to be cost-intensive. A coupling and uncoupling of the warehousing unit to and from one of the lifting devices is not addressed.

SUMMARY OF THE INVENTION

It is accordingly an object of the invention to provide a machine for folding (in short: folding machine), a machine for stitching or a machine for binding (in short jointly: machine for stitching or binding), in particular for saddle stitching (collating folded sheets and thread stitching or wire stitching: in short saddle stitcher), for adhesive binding or thread binding (adhesive binder or thread binder), a system for operating at least one machine for folding and at least one machine for stitching or a machine for binding, a lifting module, a mobile storage module and a production method, which overcome the hereinafore-mentioned disadvantages of the heretofore-known machines, systems, modules and methods of this general type and which make it possible to improve the workflow in the field of post press processing and, in particular, to reduce the production time and working time.

Developments of the invention which are advantageous and thus preferred are found in the dependent claims and in the description and the drawings.

With the foregoing and other objects in view there is provided, in accordance with the invention, a machine for folding, comprising a delivery arm for delivering folded sheets, the machine including at least one lifting module and at least one mobile storage module, wherein the storage module can be moved horizontally toward the lifting module and away from the lifting module, the lifting module is disposed downstream of the delivery arm in the delivery direction and the lifting module includes a vertically positionable lifting level for vertically positioning a plurality of folded sheets, during the delivery of folded sheets the storage module is disposed downstream of the lifting module, and the storage module includes at least two storage levels which are vertically disposed one on top of the other and which can be driven separately for respectively putting a plurality of folded sheets into storage.

With the objects of the invention in view, there is also provided a machine for stitching or binding, having a plurality of feeders for respectively feeding folded sheets, the machine comprising a plurality of lifting modules and at least one mobile storage module for each lifting module, wherein the storage modules can be moved horizontally toward the lifting modules and away from the lifting modules, a lifting module is disposed upstream of each feeder in the feed direction and the respective lifting module includes a vertically positionable lifting level for vertically positioning a plurality of folded sheets, during the feeding of folded sheets a storage module is disposed upstream of each lifting module, and the storage module includes at least two storage levels which are vertically disposed one on top of the other and which can be driven separately for respectively taking a plurality of folded sheets out of storage.

With the objects of the invention in view, there is furthermore provided a system for providing and operating at least one machine according to the invention for folding and at least one machine according to the invention for stitching or binding, comprising a plurality of mobile storage modules, which a) during the delivery are successively coupled to the lifting module of the folding machine, which receive in each case folded sheets from the lifting module of the folding machine and store the received folded sheets, then b) are uncoupled in each case from the lifting module, and transport the stored folded sheets from the machine for folding to the machine for stitching or binding, and then c) during the feeding are coupled to one respective lifting module of the machine in parallel, and discharge the transported folded sheets to the respective lifting module of the machine in parallel.

With the objects of the invention in view, there is additionally provided a lifting module for folded sheets, which is suitable for use as a lifting module of a machine for folding, a machine for stitching or binding, or when providing and operating a system according to the invention, the lifting module comprising a vertically movable lifting level for vertically positioning a plurality of folded sheets, the lifting level including a driving first coupling element of a coupling device.

With the objects of the invention in view, there is also provided a mobile storage module for folded sheets which is suitable for use as a storage module of a machine according to the invention for folding, a machine according to the invention for stitching or binding, or when providing and operating a system according to the invention, the storage module comprising at least two storage levels which are vertically disposed one on top of the other and which can be driven separately, for the respective storage of a plurality of folded sheets, the storage levels including one respective driven second coupling element of a coupling device.

With the objects of the invention in view, there is concomitantly provided a production method for manufacturing post-processed printed products formed of folded sheets, which comprises using a plurality of lifting modules according to the invention and a plurality of storage modules according to the invention, wherein one respective lifting module and one respective storage module are temporarily coupled together via a coupling device, and the coupling device includes the first coupling element of the lifting module and a second coupling element of the storage module.

Advantageous Embodiments and Effects of the Invention

The invention advantageously makes it possible to improve the workflow in the field of post press processing and, in particular, to reduce the production time and working time.

The invention improves the workflow in a print shop between successive machines in the production process, for example between folding machines and saddle stitchers/adhesive binders/thread binders. Errors and delays in the workflow can be avoided. Less intervention is required by operating personnel. The productivity can be increased. The invention can represent a "building block" for the concept of the autonomous print shop, in particular when the mobile storage modules are autonomously moved and the folded sheets are transported automatically from one machine to the other machine.

According to the invention, for example, in an assembly of a (production) system formed of different machines, lifting modules are provided and used for the vertical movement and positioning of folded sheets, and mobile storage modules are provided and used for the horizontal movement and positioning of folded sheets. The storage modules can temporarily store or buffer the folded sheets and transport them between the machines of the assembly. While the storage modules are mobile, for example rollable, the lifting modules are preferably disposed in a stationary manner in the machines. The storage modules and lifting modules can be coupled to one another, wherein preferably a drive train is produced for the storage elements (circulating belts) of the storage modules. An associated motor can be provided in the lifting module. No motors need to be provided in the storage modules, whereby they are more lightweight and cost-effective.

In a print shop with at least one folding machine and at least one post processing machine, such as for example a saddle stitcher, an adhesive binder or a thread binder, preferably a plurality of storage modules can be present ("pool of storage modules"). The transport of the folded sheets between the machines can be implemented thereby. Moreover, previously produced folded sheets can also be temporarily stored until the post processing. In this manner, last-minute jobs can also be fitted in. The storage modules are preferably of very simple construction and as a result very cost-effective, so that it is possible for a business to acquire many such storage modules.

The folded sheets can be disposed on the storage levels of the storage modules in stacks, i.e. one on top of the other ("stored flat"). Preferably, a plurality of stacks are disposed adjacent to one another for each storage level. Alternatively, the folded sheets can be disposed on the storage levels of the storage modules in a row, i.e. adjacent to one another ("stored upright"). The storage modules can accordingly be adapted to the different types of delivery of the folding machine (flat delivery, upright delivery).

Developments of the Invention

Preferred developments of the invention (in short: developments) are described hereinafter. These developments can also be combined together—where it is not technically excluded.

Developments of the Machines

One development can be distinguished in that the lifting level has a conveying element for the conveyance when putting the folded sheets into storage or taking them out of storage in the respective vertical position and a drive for the conveying element. The conveying element can be configured as a circulating belt. The belt can be driven, for example it can include a driven roller. Stops or support elements for the folded sheets or the stacks thereof can also be provided on the belt.

One development can be distinguished in that the storage levels in each case have a conveying element for the conveyance when putting the folded sheets into storage or taking them out of storage. The conveying element can be configured as a circulating belt. The belt can be indirectly driven, for example via the conveying element of the lifting device. Stops or support elements for the folded sheets or the stacks thereof can also be provided on the belt.

One development can be distinguished in that the storage levels are configured in each case to be able to be coupled to the lifting level, for separately driving the storage levels. One respective conveying element of the storage level and the conveying element of the lifting level can be temporarily coupled together if they are located at the same vertical position. In this manner, folded sheets can be transported in the horizontal plane from the lifting level to a storage level (and vice versa). The two levels are preferably disposed at the same vertical position and with their respective ends closely adjacent to one another.

One development can be distinguished in that the lifting level includes a driving first coupling element of a coupling device and each storage level includes one respective driven second coupling element of the coupling device. The coupling can take place, for example, via gearwheels or friction wheels as coupling elements.

Developments of the Provision and Operation of a System

One development can be distinguished in that a warning device is activated on the machine for stitching or binding when the correct storage module is not positioned on the correct feeder. The warning can be implemented, for example, visually or acoustically. For example, an operator can be warned by a red light and/or a loud sound that the storage module has not been moved onto the correct lifting module. It can also be provided that the correct position is displayed to the operator by another lamp on a further lifting module. It can also be provided that the storage modules are numbered consecutively and provided with transponders in such a way that when a storage module approaches a series of lifting modules with the correct lifting module, a display is activated, for example a green lamp; in this manner the operator locates the correct lifting module in a rapid and uncomplicated manner. Alternatively, the storage modules can be moved by being computer-controlled, wherein it is ensured that the correct storage modules (with the anticipated number of folded sheets) are positioned at the correct time at the correct location.

One development can be distinguished in that a plurality of storage modules are docked at the same time on the lifting module of the folding machine and are loaded at the same time or one after the other. It can also be provided to pass folded sheets through a storage module and to feed the folded sheets into a further storage module located downstream.

One development can be distinguished in that, when a storage module is loaded, a counter is activated and correspondingly counts how many folded sheets or stacks thereof are put into storage. The count value can be saved and can be recalled for monitoring purposes when the storage module is unloaded.

One development can be distinguished in that a computer is provided, the computer monitoring and recording the loading of a plurality of storage modules and monitoring and recording which (optionally different) folded sheets have been put into storage and optionally in which number and in which storage module and optionally on which storage level (vertical position) and optionally at which position on a storage level (horizontal position). In this manner, the computer has a comprehensive knowledge of which folded sheets are currently temporarily stored where in the pool of storage modules, and can contribute in this manner to improving the workflow, in particular in the event of a spontaneous change of job.

One development can be distinguished in that different storage modules are used. For example, storage modules can be provided with different storage capacities for folded sheets. Such storage modules can have, for example, different lengths and/or different heights or different numbers of storage levels.

One development can be distinguished in that a plurality of lifting modules are provided on the folding machine and in this manner a plurality of storage modules can be filled in parallel. The individual folded sheets can be guided via a shunt to the different lifting modules.

One development of the folding machine can be distinguished in that it includes a robot with a robot arm in the region of its delivery arm, and in that the robot arm is used to stack folded sheets or stacks thereof on pallets. The folding machine can include a shunt so that an operator or a control program can select whether the folded sheets are supplied to the lifting module or the robot. For example, small print runs can be put into storage or deposited into storage modules via the lifting module and large print runs can be put into storage or deposited onto pallets via the robot.

Developments of the Lifting Module

One development can be distinguished in that the lifting level includes a movable belt for the conveyance when putting the folded sheets into storage or taking them out of storage.

One development can be distinguished in that a plurality of storage modules can be docked at the same time on the lifting module, for example on different sides of the module. These storage modules can optionally be loaded one after the other or even at the same time.

Developments of the Storage Module

One development can be distinguished in that the storage levels in each case include a movable belt for the conveyance when putting the folded sheets into storage or taking them out of storage. The belt can have measures which make it possible to fix the folded sheets securely for transport, for example stop surfaces oriented perpendicularly to the belt.

It is possible via each storage level or via each individual stack to mount one respective (transport) securing plate which can preferably be guided laterally on the storage module (for example on the side wall thereof) for a vertical movement. When filling the storage module (putting into storage) and when emptying the storage module (taking out of storage) the plates can be pushed into an upper position. When moving the storage module, the plates can be placed on the stack: the plates are positioned with their weight force and are possibly also even spring-loaded. The upper position of the plates in each level is preferably the same; the lower position is produced by the respective stack height(s). The plates can be moved by hand in the vertical plane. Alternatively, it can be provided to move the plates by using a drive in the vertical plane; this drive is preferably disposed in the lifting module and during the coupling of the storage module is also coupled to one respective lifting module. Before putting the stacks into storage, all of the existing plates of the storage module are moved upwardly via the coupling (if they are not already located at the top), and downwardly after putting the stacks into storage, for secure transport; before taking the stacks out of storage all of the existing plates of the storage module are moved upwardly via the coupling; and after the stacks are taken out of storage the plates preferably remain at the top.

One development can be distinguished in that the storage module is provided without a dedicated drive for the storage levels thereof, for example for the circulating belts thereof.

If necessary, a drive can alternatively be provided in the lifting module and can be used both for the lifting module and for the storage modules (for example for the belts circulating therein).

One development can be distinguished in that the storage module receives folded sheets (or stacks of such folded sheets) from different production jobs. This is expedient, in particular, in production jobs with small print runs.

One development can be distinguished in that the storage module is pushed by an operator of the folding machine for stitching or binding (or vice versa) or that the storage module is autonomously moved. For the autonomous movement a storage module has to be provided with a drive. Such an autonomous storage module can be configured as a DTV ("driverless transport vehicle").

One development can be distinguished in that two or more storage modules are coupled together and moved jointly when moving between the folding machine and the machine for stitching or binding.

One development can be distinguished in that the storage module is mechanically docked to one respective lifting module of the folding machine or the machine for stitching or binding. It can be provided not to permit or to block the mechanical docking when it is identified that the correct storage module is not positioned on the lifting module.

One development can be distinguished in that the storage module has a plurality of storage levels, the respective position thereof being able to be changed in the vertical plane. In this manner, the spacing between the storage levels can be adapted to varying stack heights.

One development can be distinguished in that the storage levels of the storage module extend substantially horizontally or are horizontally oriented. This is expedient, in particular, when putting stacks of flat folded sheets into storage.

Alternatively, it can be provided to provide the storage levels with an incline. This can be expedient, in particular, when putting upright folded sheets into storage. Alternatively, it can be provided to put upright folded sheets into storage in cassettes and to receive these cassettes substantially horizontally in the storage modules and to transport them therewith.

Developments of the Production Method

One development can be distinguished in that the individual folded sheets or stacks of folded sheets are provided with one respective coding. The coding can be generated in one (or more) printing machine(s) disposed upstream in the production process or alternatively in the folding machine. The coding can be in each case a barcode or a QR code, or the like, or alternatively an attached RFID chip, or the like. The coding can be used to identify clearly the individual folded sheets or stacks of folded sheets. The identification can serve to ensure that no errors occur in the production process. It is possible to prevent, for example, the feeding of incorrectly folded sheets.

One development can be distinguished in that excess folded sheets on the machine for stitching or binding are either ejected as wastepaper or returned for storage in a storage module. Folded sheets which are returned for storage can be moved with the storage module to a wastepaper container and disposed of there.

The features and combinations of features relating to the technical field, invention and developments disclosed in the above paragraphs and relating to the exemplary embodiments disclosed in the following paragraph represent—in any combination with one another—further advantageous developments of the invention.

Other features which are considered as characteristic for the invention are set forth in the appended claims.

Although the invention is illustrated and described herein as embodied in a folding machine, a stitching or binding machine, a system for operating a folding and stitching or binding machine, a lifting module for folded sheets, a mobile storage module for folded sheets, and a production method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
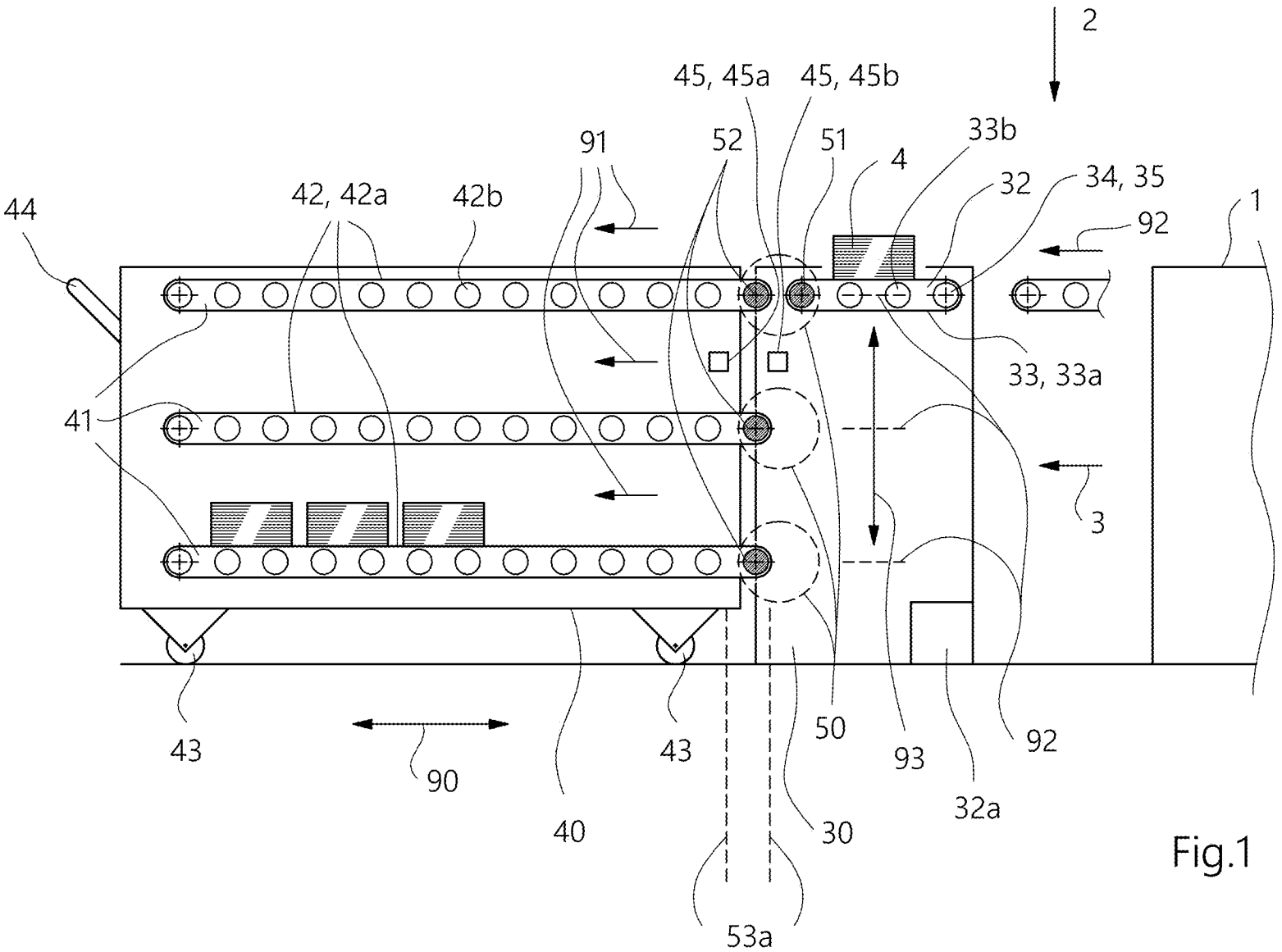
FIG. 1 is a fragmentary, diagrammatic, longitudinal-sectional view of a preferred exemplary embodiment of the invention having a storage module, a lifting module and a folding machine or a delivery arm thereof and a diagrammatic illustration of the sequence of putting into storage during operation.

Referring now in detail to the figures of the drawings, in which features which correspond to one another are provided with the same reference signs and repeated reference signs have been omitted in some cases for the sake of clarity, and first, particularly, to FIG. 1 thereof, there is seen a diagrammatic representation of a sectional view of a preferred exemplary embodiment with a storage module, a lifting module and a folding machine or the delivery arm thereof and diagrammatically the sequence of putting into storage during operation. The putting into storage of the folded sheets 4 (from the machine 1 into one or more storage module(s) 40) takes place according to the sequence shown in FIG. 1. The machine 1 (folding machine; only shown partially) includes a delivery arm 2 (also only shown partially) with a preferably horizontal delivery direction 3 for folded sheets 4 or stacks of such folded sheets/folded sheet stacks 4 (flat delivery or flat storage). Such a machine 1 can be part of a system 20 formed of different machines 1 and 10.

The folded sheets 4 pass from the delivery arm 2 to a lifting module 30 or to the lifting level 32 thereof, which when actuating a drive 32*a* is movable in the direction 93 ("up and down") and thus can be positioned in vertical positions 92.

The movable lifting level 32 includes a conveying element 33 which preferably can include a circulating belt 33*a* and rollers 33*b* for guiding the belt. The conveying element 33 is driven, i.e. a drive 34 is present, preferably a motor for one of the rollers 33*b*. Further below (in the description of the storage module) it is made clear that this drive 34 at the same time (in the coupling state) represents a drive of a coupling device.

The folded sheets 4 pass from the lifting module 30 to the storage module 40 (coupled in a docking region 53*a*). While the lifting module 30 is preferably fixedly disposed (in the delivery arm 2 or alternatively as part of the delivery arm 2) the storage module 40 is configured to be mobile, preferably by providing wheels 43 and a handle 44 in such a way that an operator can move the storage module 40 toward the lifting module 30 and away again (see double arrow direction 90).

The storage module 40 preferably includes a plurality of storage levels 41 disposed one on top of the other for storing folded sheets 4, wherein each of these levels includes a conveying element 42, preferably a circulating belt 42*a* and rollers 42*b*, for guiding the belt. Since the lifting level 32 can be driven to different positions 92, it is possible to supply the folded sheets 4 to the different storage levels 41 via the lifting level 32. The supply is carried out in the direction 91. This preferably takes place in a controlled manner, i.e. a computer, for example the computer 70 shown in FIG. 4, controls the putting into storage of the folded sheets 4 according to the number of folded sheet stacks 4 to be stored and the storage capacity of the storage modules 40 being used. Preferably, the storage modules are completely filled; when changing jobs, however, it can also arise that a storage module is only partially filled.

Figure 2:
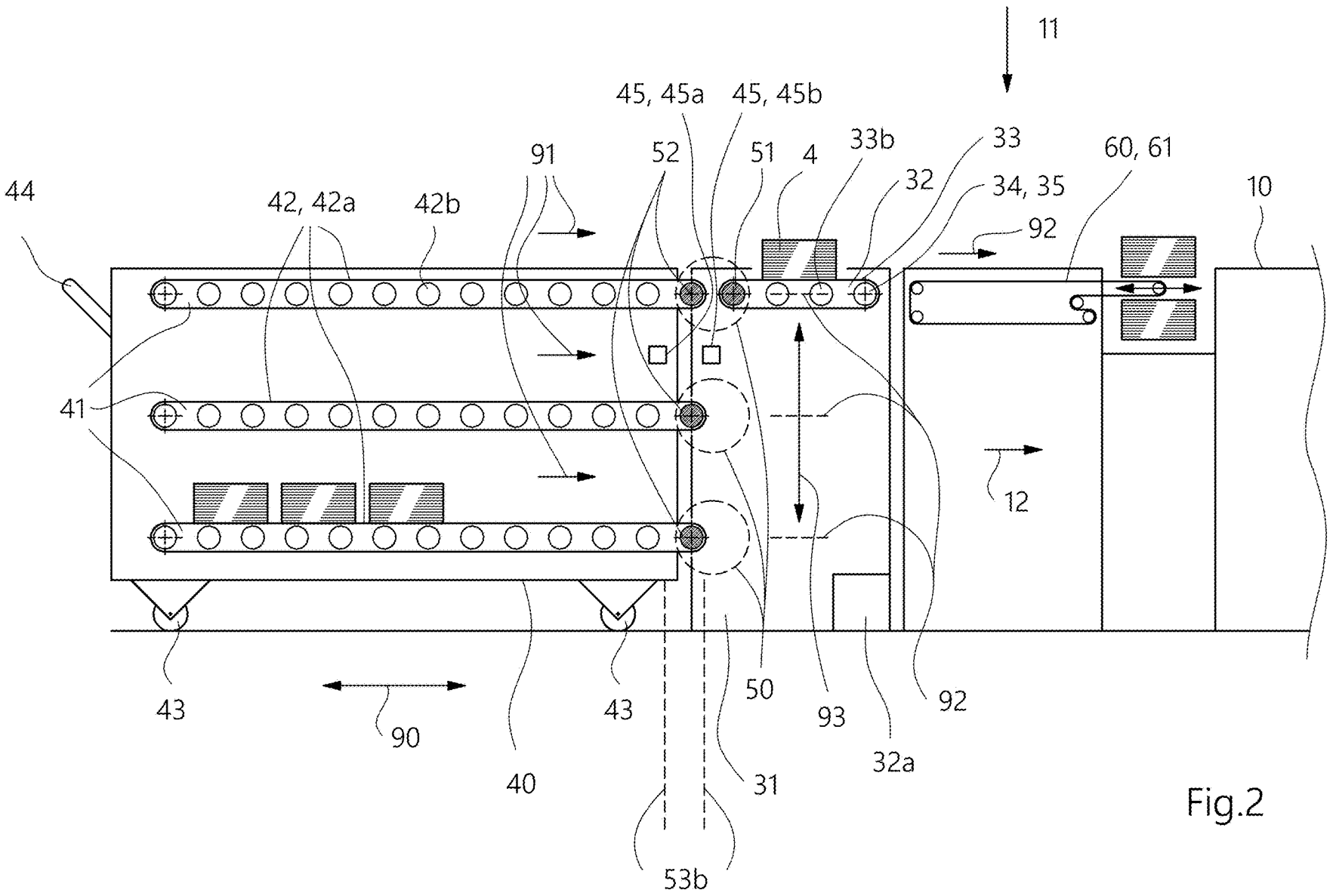
FIG. 2 is a view similar to FIG. 1 of a further development of the invention having a storage module, a lifting module and a saddle stitcher, an adhesive binder or a thread binder or the feeder thereof and a diagrammatic illustration of the sequence of taking out of storage during operation.
Figure 3:
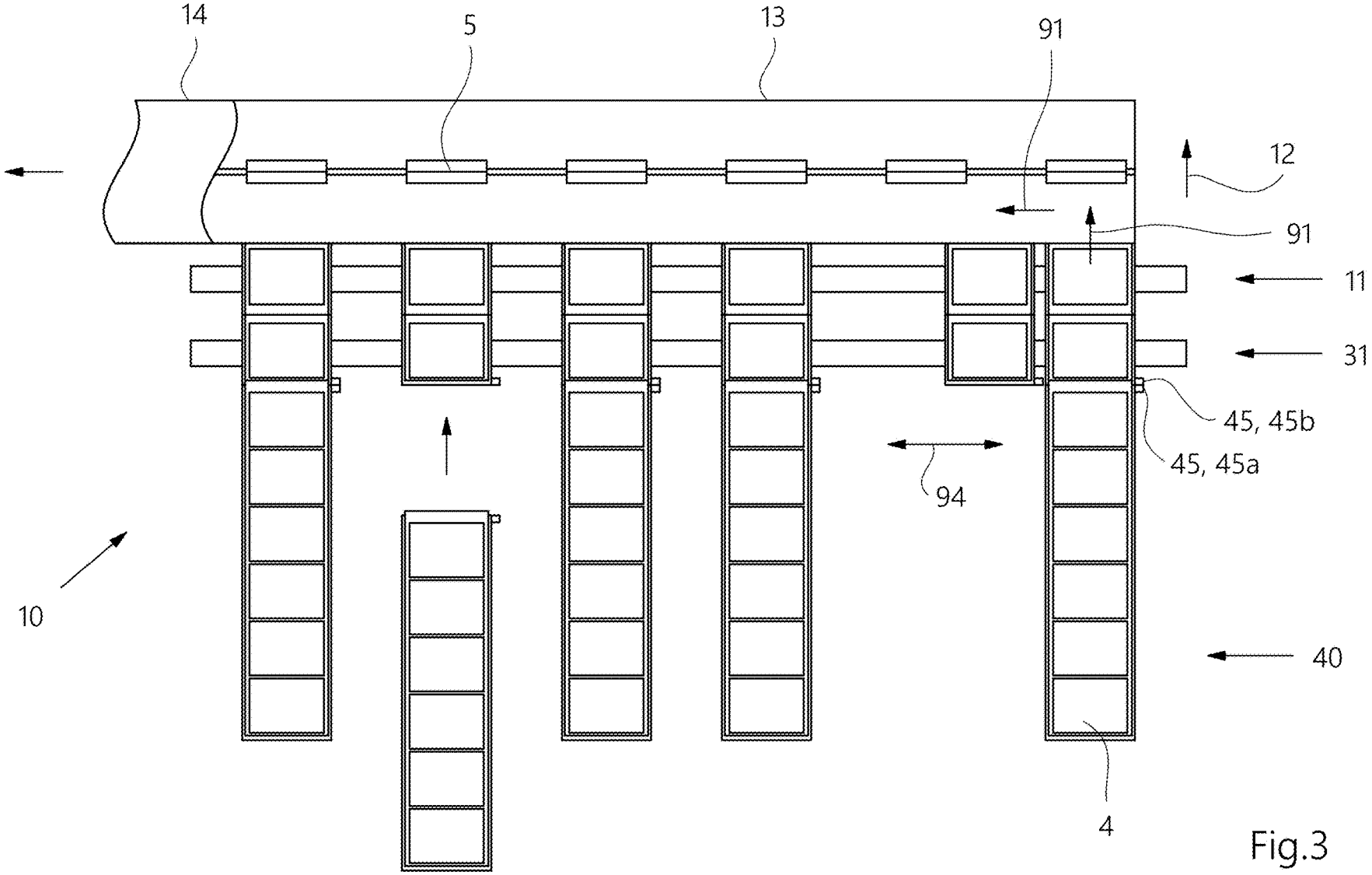
FIG. 3 is a plan view of a preferred exemplary embodiment having a plurality of storage modules, a plurality of lifting modules and a saddle stitcher, an adhesive binder or a thread binder and a diagrammatic illustration of the sequence of taking out of storage during operation.
Figure 5:
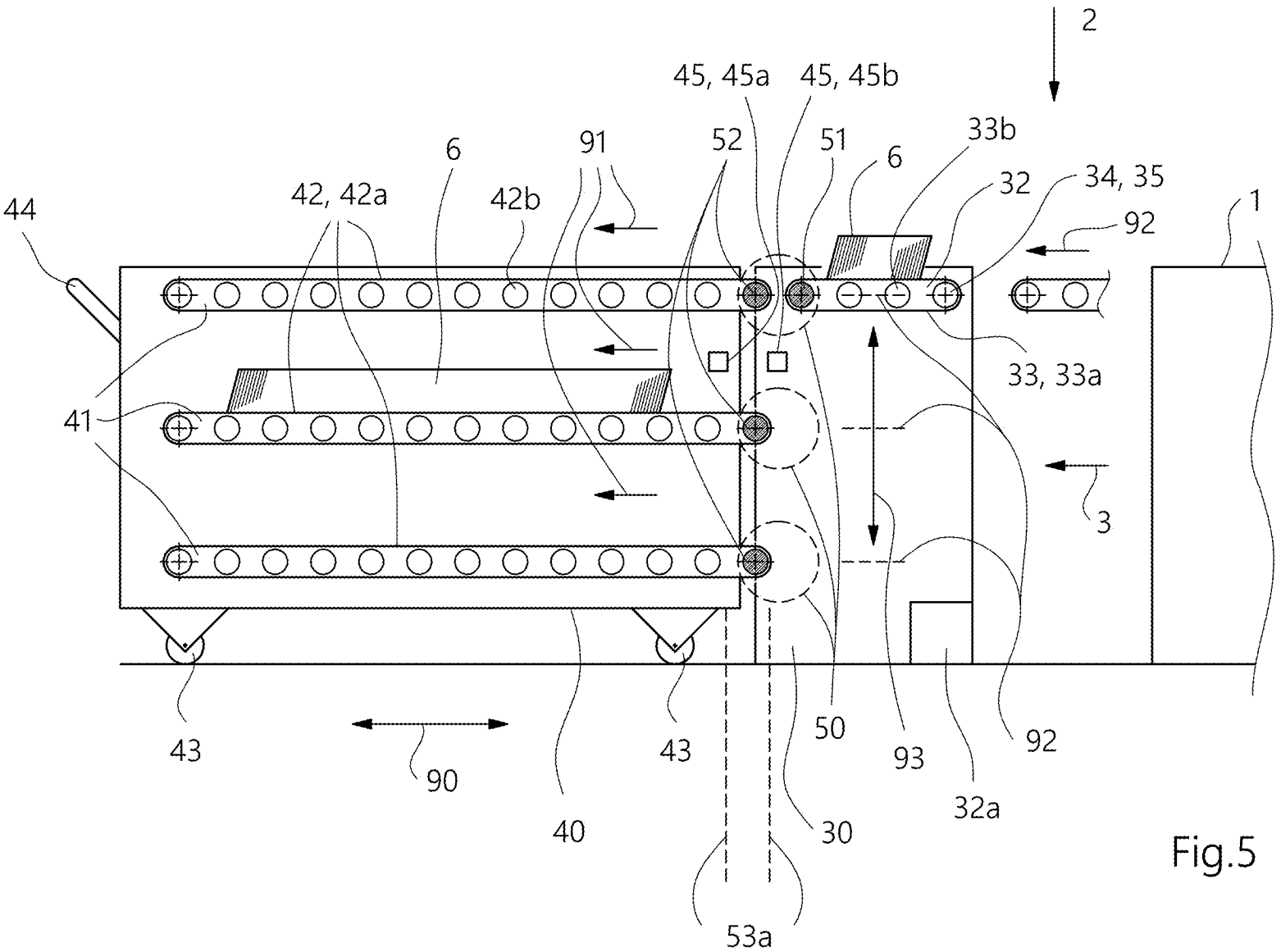
FIG. 5 is a sectional view of a preferred exemplary embodiment with a storage module, a lifting module and a folding machine or the delivery arm thereof and a diagrammatic illustration of the sequence of putting into storage during operation.

A (multipart) coupling device 50 is present for producing a coupling between a storage module 40 and a lifting module 30. The coupling device 50 includes a first coupling element 51 and a second coupling element 52. The first coupling element 51 is part of the lifting module 30; the second coupling element 52 is part of the storage module 40. The two coupling elements can be configured, for example, as gearwheels which mesh when the two modules 30 and 40 are coupled. On the side of the storage module 40, each storage level 41 can include a second coupling element 52, i.e. the second coupling element can itself be in multiple parts, for example it can include a plurality of gearwheels. The lifting level 32 can preferably be coupled in each of its vertical positions 92 to a storage level 41; thus, for example, it can be provided that a gearwheel of the lifting level is coupled to one respective gearwheel of the storage level. In FIGS. 2, 3 and 5 such gearwheels are represented as filled circles.

FIG. 2 shows a diagrammatic representation of a sectional view of a preferred exemplary embodiment with a storage module, a lifting module and a saddle stitcher, an adhesive binder or a thread binder or the feeder thereof and diagrammatically the sequence of taking out of storage during operation. The machine 10 (saddle stitcher, adhesive binder or thread binder; only partially shown) includes a feeder 11 (also only partially shown) with a preferably horizontal feed direction 12 for folded sheets 4 or stacks of such folded sheets/folded sheet stacks 4. The folded sheets 4 are taken out of storage (from one or more storage module(s) 40 in the machine 10) according to the sequence shown in FIG. 2; this sequence is carried out substantially in the reverse sequence and in the reverse directions to putting into storage.

An at least partially loaded storage module 40 can be decoupled by the operator and moved from the machine 1 (folding machine) to the machine 10 (saddle stitcher, adhesive binder or thread binder) and coupled there (docking region 53*b*). The uncoupling is preferably carried out simply by removing the storage module 40 from a predetermined position, for example away from a stop of the lifting module 30 of the machine 1; the coupling is carried out by moving into a predetermined position in the lifting module 31, for example toward a stop of the lifting module 31 of the machine 10.

One respective folded sheet stack 4 which has been put into storage is moved by using the relevant conveying element 42 of the storage module 40 and the correspondingly vertically positioned and coupled conveying element 33 of the lifting module 31 to the lifting level 32; this then moves upwardly with the stack 4; then the stack 4 is moved onto the feeder 11 (alternative term: feed module or insert module) or the conveying element 60 thereof and finally into the machine 10 for post processing therein. The conveying element 60 can be configured to be extendable, for example as a circulating belt 61. Successive stacks 4 can be moved apart on the feeder 11 if the individual folded sheets are pulled downwardly.

FIG. 3 shows a diagrammatic representation of a plan view of a preferred exemplary embodiment with a plurality of storage modules, a plurality of lifting modules and a saddle stitcher, an adhesive binder or a thread binder and diagrammatically the sequence of taking out of storage during operation.

It can be identified that a plurality of storage modules 40 can be coupled (docked) to the feeder 11 of the machine 10: to this end the feeder 11 includes a collation section 13 known per se which guides the folded sheets 5 taken out of storage and collated from the storage modules 40 to a post processing station 14 (movement directions 91). It can also be identified that the feeder 11 and the lifting modules 31 can preferably be moved in a direction 94, whereby it is easier for the operator to access the machine 10 or the collating section 13 thereof, for example in the case of a malfunction.

It is preferably provided that each storage module 40 includes one respective first monitoring element 45*a* and each lifting module 30 or 31 includes one respective second monitoring element 45*b* of a monitoring device 45. The monitoring elements 45*a* and 45*b* can communicate via contacts or preferably contactlessly (for example via RFID; remotely) with one another and/or with a computer, for example the computer 70, wherein for example it is identified which storage module is to be placed on which lifting module; the placing can be prevented if it is identified that a storage module would not be placed on the correct lifting module—for the production process. The prevention can include a warning (acoustic and/or visual). The prevention can include a mechanical solution, for example a lock (not shown) which blocks the docking. The warning and lock can also be combined together.

Figure 4:
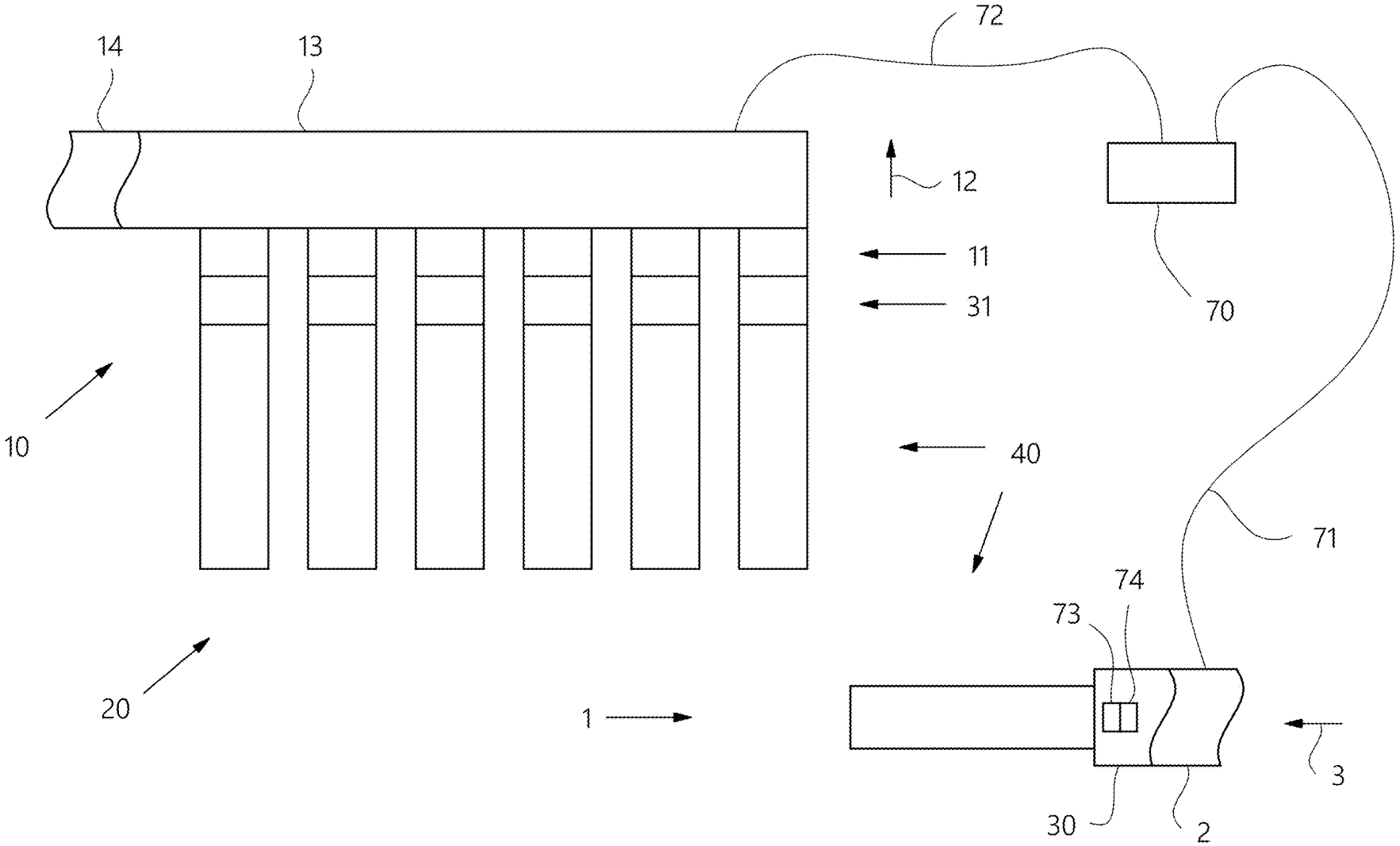
FIG. 4 is a plan view of a preferred exemplary embodiment with a plurality of storage modules, a plurality of lifting modules, a folding machine and a saddle stitcher, an adhesive binder or a thread binder and a diagrammatic illustration of the sequence of putting into storage and taking out of storage during operation.

FIG. 4 shows a diagrammatic representation of a plan view of a preferred exemplary embodiment with a plurality of storage modules, a plurality of lifting modules, a folding machine and a saddle stitcher, an adhesive binder or a thread binder and diagrammatically the sequence of putting into storage and taking out of storage during operation.

The exemplary system 20 shown includes a folding machine 1 with a delivery arm 2, and a delivery direction 3, a lifting module 30 and preferably with a sensor 73 for detecting folded sheet stacks 4 passing through and with a counter 74 for counting the stacks. The counting can serve to identify when a docked storage module is fully loaded or when a further storage module has to be loaded.

The system 20 also includes a machine 10, for example a saddle stitcher, an adhesive binder or a thread binder with a plurality of lifting modules 31, a plurality of feeders 11 with feed directions 12 and preferably with a collating section 13.

The system finally includes a "pool" of storage modules 40 which can be moved back and forth between the two machines 1 and 10 as a function of the production. The operation of the system 20 or the production can be monitored and controlled by the computer 70: the computer 70 is connected to both machines 1 and 10 via respective connections 71 and 72, preferably wirelessly. The computer 70 also identifies the loading state of the individual storage modules 40, i.e. which folded sheets 4 are put into storage in which modules 40. The computer can display to the operator which module 40 (these can be numbered consecutively, for example, or coded in a different manner by known measures) has to be docked at which time on which module 30; this can take place, for example, via display devices on the modules 30. If the modules 40 are optionally configured as DTVs ("driverless transport vehicles") the control of the production can also take place autonomously, i.e. without the operator.

FIG. 5 shows a diagrammatic representation of a sectional view of a preferred exemplary embodiment with a storage module, a lifting module and a folding machine or the delivery arm thereof and diagrammatically the sequence of putting into storage during operation. While in FIG. 1 the storage is flat, in FIG. 5 the storage is upright.

The upright storage can be expedient if the machine 1 located upstream itself includes a delivery arm for upright folded sheets 4 and the machine 10 located downstream permits the arrangement of folding sheets 4 stored upright.

The upright storage of folded sheets 4, i.e. of folded sheets which are not located substantially vertically on top of one another (are disposed as vertical stacks) but substantially horizontally, optionally with an incline adjacent to one another (are disposed as horizontal stacks) can be advantageous since optionally more folded sheets 4 per module 40 can be put into storage. The usual conveying elements 42, however, optionally have to be additionally provided with (front and optionally end) supports for the row of upright folded sheets 4; the supports can be adjustable, for example, in order to permit putting into storage and taking out of storage.

The following is a summary list of reference numerals and the corresponding structure used in the above description of the invention:

1 Machine for folding or folding machine
2 Delivery arm
3 Delivery direction
4 Folded sheets or folded sheet stack (flat)
5 Folded sheets
6 Folded sheets or folded sheet stack (upright)
10 Machine for stitching or binding (saddle stitcher/adhesive binder/thread binder)
11 Feeder
12 Feed direction
13 Collating section
14 Post processing station (stitching or adhesive binding)
20 System formed of folding machine and saddle stitcher/adhesive binder/thread binder
30 Lifting module(s) of folding machine
31 Lifting module(s) of saddle stitcher/adhesive binder/thread binder
32 Lifting plane(s)
**32*a*** Drive of lifting level
33 Conveying element
**33*a*** Circulating belt, circulating belts
**33*b*** Rollers
34 Drive of conveying element
35 Drive of coupling device
40 Storage module(s)
41 Storage level(s)
42 Conveying element(s)
**42*a*** Circulating belt, circulating belts
**42*b*** Rollers
43 Wheels
44 Handle
45 Monitoring device
**45*a*** First monitoring element
**45*b*** Second monitoring element
50 Coupling device
51 First coupling element
52 Second coupling element
**53*a*** Docking region in folding machine
**53*b*** Docking region in saddle stitcher/adhesive binder/thread binder
60 Extendable conveying element
61 Circulating (extendable) belt
70 Computer
71 Connection to folding machine
72 Connection to saddle stitcher/adhesive binder/thread binder
73 Sensor
74 Counter
90 Movement direction storage module
91 Movement directions folded sheets/stack
92 Vertical position
93 Movement direction lifting level(s)
94 Movement direction lifting module and feeder (in the case of servicing)

The invention claimed is:

1. A production method for manufacturing post-processed printed products formed of folded sheets, the production method comprising:

providing a delivery arm for delivering the folded sheets;

providing a plurality of lifting modules downstream of said delivery arm in a delivery direction, said plurality of lifting modules each including a vertically positionable lifting level for vertically positioning a plurality of the folded sheets, said vertically movable lifting level including a driving first coupling element of a coupling device;

providing a plurality of mobile storage modules movable horizontally toward said plurality of lifting modules and away from said plurality of lifting modules, said plurality of storage modules disposed downstream of said plurality of lifting modules during a delivery of the folded sheets;

said plurality of storage modules each including at least two storage levels disposed vertically on top of one another, said at least two storage levels being separately drivable for respectively putting a plurality of the folded sheets into storage, and said at least two storage levels each including one respective driven second coupling element of said coupling device;

using said coupling device to temporarily couple one respective lifting module and one respective mobile storage module together;

said coupling device including said first coupling element of said lifting module and said second coupling element of said mobile storage module.

* * * * *